United States Patent [19]

Bodine

[11] 4,261,425

[45] Apr. 14, 1981

[54] MECHANICALLY NUTATING DRILL DRIVEN BY ORBITING MASS OSCILLATOR

[76] Inventor: Albert G. Bodine, 7877 Woodley Ave., Van Nuys, Calif. 91406

[21] Appl. No.: 64,046

[22] Filed: Aug. 6, 1979

[51] Int. Cl.[3] ..... E21B 7/24

[52] U.S. Cl. ..... 175/106; 175/55; 175/107; 74/61

[58] Field of Search ..... 175/55, 56, 92, 106, 175/107; 74/61, 87; 418/48

[56] References Cited

U.S. PATENT DOCUMENTS

| | | | |
|---|---|---|---|
| 747,869 | 12/1903 | Drake | 175/106 X |
| 1,580,001 | 4/1926 | Bicknell | 175/106 X |
| 2,902,258 | 9/1959 | Hildebrandt | 175/56 |
| 3,049,185 | 8/1962 | Herbold | 175/92 X |
| 3,603,407 | 9/1971 | Clark | 175/6 |
| 3,746,310 | 7/1973 | Fransson et al. | 418/48 X |

FOREIGN PATENT DOCUMENTS

| | | | |
|---|---|---|---|
| 159775 | 8/1962 | U.S.S.R. | 175/55 |

*Primary Examiner*—James A. Leppink
*Assistant Examiner*—Richard E. Favreau
*Attorney, Agent, or Firm*—Edward A. Sokolski

[57] ABSTRACT

A drill bit is coupled at its upper end to an orbiting mass oscillator. The oscillator is mounted and connected to the bit such that the oscillator describes a conical orbiting path. The drill bit follows this conical orbiting path of the oscillator which results in a rolling nutating action of the bit cutters on the work material.

8 Claims, 8 Drawing Figures

MECHANICALLY NUTATING DRILL DRIVEN BY ORBITING MASS OSCILLATOR

This invention relates to the drilling of earthen material, masonry, concrete and rock, and more particularly to a drilling system for such purpose in which the drill bit is driven against the work piece with a rolling or nutating motion.

In the drilling of hard materials, such as concrete, rock, etc., as for example in mining operations, well drilling and construction work, considerable energy is needed. Thus, it is extremely important that the drill be operated at optimum efficiency. Further, in typical prior art drills, substantially the entire surface of the bit is in contact with the work piece at all times which tends to overheat the bit and wear down its teeth rather rapidly, particularly when dealing with hard material such as rock, masonry and concrete.

The device of the present invention provides a significant improvement over prior art drills of the type mentioned above in that the nutating rolling action causes various portions of the drill bit to come into successive engagement with the work piece with each drill portion having a non-contacting or rest period during the vibratory nutation cycle. This lessens the tendency of the bit to overheat and further provides vibratory "stabbing" action against the work piece to enhance drilling action such as by vibratory fatigue of rock. Further, the straight down stabbing action tends to sharpen the teeth of the drill bit, while the nutating motion thereof tends to effectively mix the cuttings into suspension in the drill mud which thus acts to flow such cuttings away from the drilling area.

The system of the present invention achieves the aforementioned nutating drilling action in the following manner: a sonic oscillator of the orbiting mass type which has an unbalanced rotor is driven at a speed above 40 rps (typically of the order of 100 cps). The output of this oscillator is coupled to a drill bit which is used to drill into rock, concrete, masonry or other hard material. Means are provided for mounting the oscillator and connecting it to the drill bit such that it induces a conical orbital motion of the bit at the vibration frequency of the oscillator. This conical orbital motion causes a nutating rolling action of the bit against the work material with a cyclical hammering or stabbing action.

It is therefore an object of this invention to provide a simple, mechanical tool which has improved efficiency in effecting high frequency vibratory fatigue of the work material in the drilling of hard materials such as rock, concrete and masonry.

It is a further object of this invention to provide an improved mechanical hard material drill employing nutating cyclical drilling action in which wear on the drilling teeth is lessened.

It is a further object of this invention to provide an improved drilling tool for hard material employing nutating drilling action wherein the nutating action aids in the removal of drill cuttings from the work area.

Other objects of this invention will become apparent as the description proceeds in connection with the accompanying drawings of which:

Figure 1:
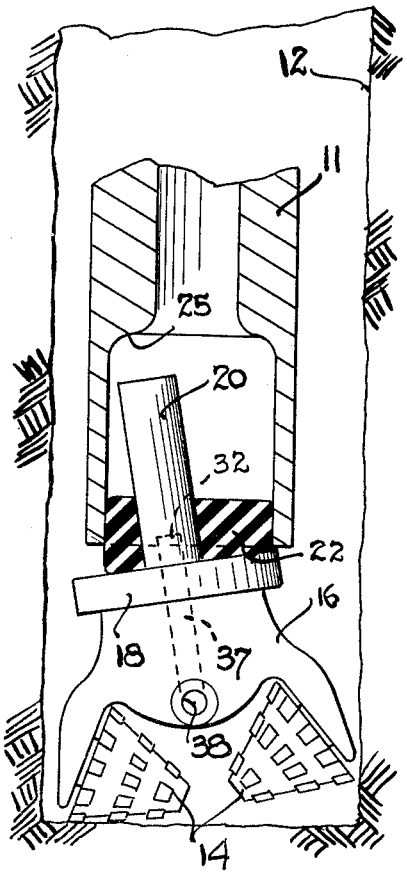
FIG. 1 is a cross-sectional view in elevation of a first embodiment of the invention.
Figure 2:
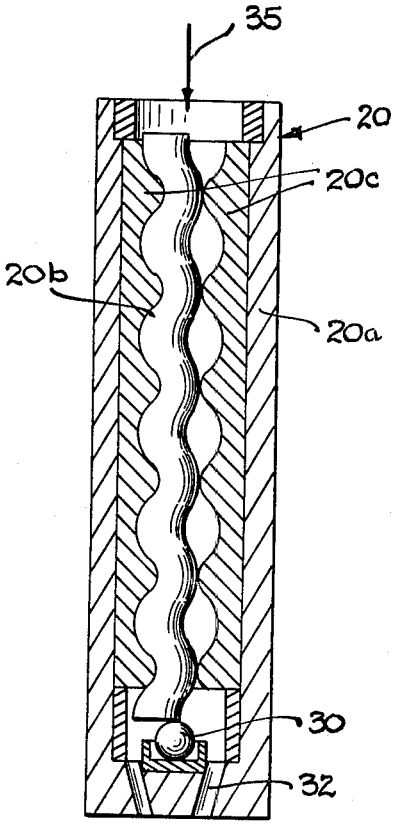
FIG. 2 is a cross-sectional view in elevation of an oscillator which may be used in the first embodiment.

Referring now to FIGS. 1 and 2, a first embodiment of the invention is illustrated. Drill collar 11 is suspended from a conventional drill rig into the borehole 12 and rotated to effect the normal drilling action of drill bit cones 14. Drill bit cones 14 are conventional roller cones in a bit assembly, such as bits commercially available from the Smith Tool Company, the Reed Rool Company, and Hughes Tool Company. The drill collar 11 is resiliently attached to drilling bit member 16 by means of rubber bushing coupler member 22. Bit member 16 has roller cone cutters 14. Oscillator 20 has a casing **20*a* which is fixedly attached to plate member 18 forming a thrust shoulder which is integrally formed with the bit member 16. The oscillator 20 is contained within jacket portion 25 which forms the lower end of the drill collar 11. Rubber bushing 22 is attached to jacket 25, plate 18 and the casing 20*a* of the oscillator, as for example, by vulcanization to these parts, this bushing holding the parts together resiliently for relative motion between the oscillator and jacket portion 25, and functioning as a mud seal so that mud flow from the drill collar is forced to flow through the stem and to the bit port or nozzle orifice 38**.

As shown in FIG. 2, oscillator 20 has a screw-type rotor **20*b* which is freely supported in casing 20*a*, the bottom end of the rotor abutting against thrust load ball bearing 30. Rotor 20*b* is rotatably driven in a screw-type stator 20*c*, which it matingly engages, by means of a mudstream which is fed into the top of the oscillator as indicated by arrow 35. This type of mudstream-driven rotor mechanism may be of the type used in "moyno"-type drive motors which are commonly used to drive drill stems and the like. The mud stream is fed out from the bottom of the oscillator casing through slots 32 and thence to channel 37 (see FIG. 1) from where the mud is exited out through nozzle 38 from where it passes into borehole 12. The rotatably driven rotor 20*b* causes a conical vibration of the casing 20*a* at the rolling frequency of the rotor, this vibratory rotation being transferred to bit member 16 and its cones 14, this bit vibratorily nutating as to be explained in connection with FIGS. 5A–5D. Jacket portion 25 not only confines the moving parts and limits the freedom of excursion of the oscillator orbit, but also provides isolation between the oscillator and the drill collar so that a minimal amount of vibratory energy is dissipated in the drill collar. Shoulder plate 18 continually rolls about smoothly around the bottom edge of jacket 25, thus not inducing vibration into jacket 25 or collar 11**.

While the screw-type oscillator just described has the advantage of its simplicity and economy of construction, other types of oscillator rotors providing the necessary rotary vector type output, such as that described in my U.S. Pat. No. 3,633,688, or U.S. Pat. No. 4,096,762, may also be employed where the situation permits.

Figure 3:
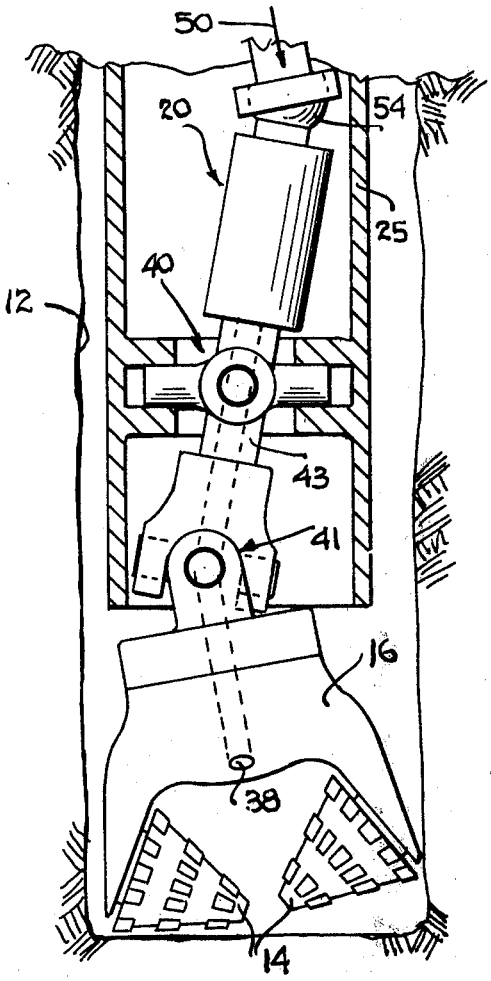
FIG. 3 is a cross-sectional view in elevation of a second embodiment of the invention.
Figure 4:
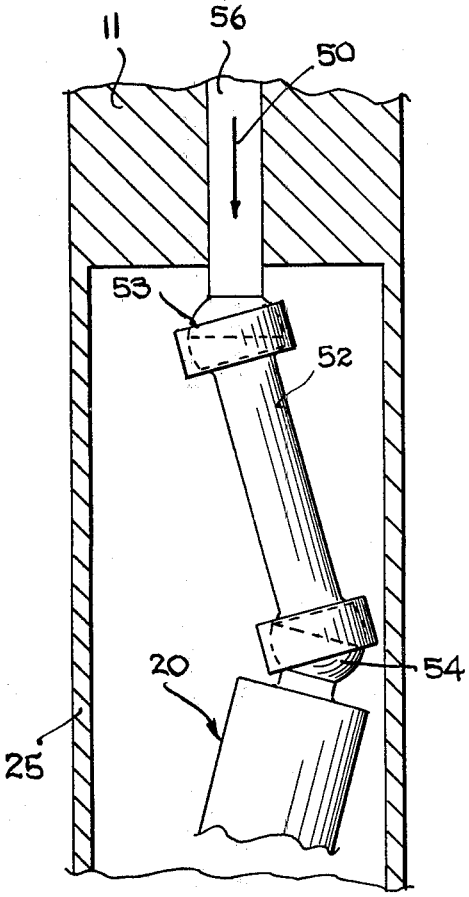
FIG. 4 is a cross-sectional view in elevation of the drive system for the second embodiment.

Referring now to FIGS. 3 and 4, a second embodiment of the invention is illustrated. In this second embodiment, oscillator 20 rather than employing a nutating thrust shoulder 18 and a resilient coupler 22 is rather supported on gimbal-type U-joints 40 and 41. Gimbals 40 and 41 both have two degrees of freedom, thereby forming a universal joint so as to permit conical vibratory motion of oscillator housing 20 and shaft 43 attached thereto, this resulting in nutation of bit roller cones 14 which operate in the same manner as in the previous embodiment. By adjusting the lever lengths of the portions of the stems on each side of the gimbals, it is possible to give the oscillator some mechanical advantage over the bit nutation force so as to improve the total power flow. The mud stream is passed to the oscillator 20 from the drill collar 11 (as indicated by arrow 50) through stub pipe 52 which is connected to the oscillator by a ball joint 54 and to mud channel 56 by similar ball joint 53.

Figure 5A:
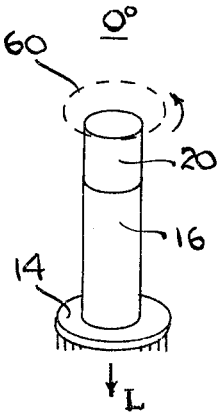
FIGS. 5A–5D are a series of schematic figures illustrating the operation of the device of the invention.
Figure 5B:
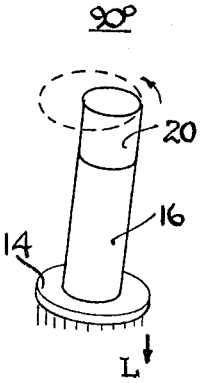
Figure 5C:
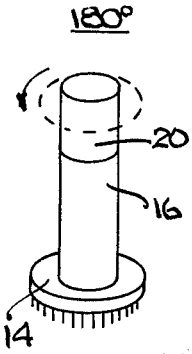
Figure 5D:
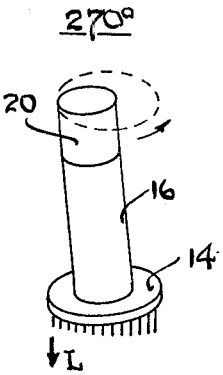

Referring now to FIGS. 5A–5D, the operation of the system of the invention is schematically illustrated in a series of pictorial drawings showing the bit, oscillator and stem in various portions of the nutating vibration cycle. The cutting portion 14 of the bit 16, for convenience of illustration, is shown in the form of a flat disc, this disc being driven in response to the orbital vibration of oscillator 20. It is first to be noted that in view of the fact that the bit surface 14 is gravity biased by the weight of the drill string against the work material, the bit is constrained by the work material and functions pivotally thereagainst. The top end of the oscillator, on the other hand, is free to move orbitally about a circular path indicated by dotted lines 60. The combined assembly formed by the oscillator and bit thus transcribes a conical orbiting path with the base of the cone being at the top of the oscillator. The oscillator is thus in the maximum orbit region where it has maximum energy input advantage. If we arbitrarily assume that FIG. 5A shows the elements at the start of the vibratory nutating cycle, or 0° position, the FIG. 5B shows the 90¶, FIG. 5C the 180°, and FIG. 5D the 270° position of these elements.

It is again to be kept in mind that while this vibratory nutating action is occurring at a frequency in excess of 40 hertz, the drill bit is being slowly rotated in its normal mode of drilling operation, the vibratory nutating action greatly enhancing the normal drilling action by virtue of the fact that the bit teeth are vibratorily hammered into the rock by the higher frequency vibratory nutation. This cyclical "stabbing" of the teeth against the work material tends to sharpen them. Further, the nutating action periodically relieves the pressure of the teeth from the work piece, enabling the teeth to more effectively cool, thereby lessening wear thereon. Additionally, the vibratory nutation of the teeth tends to mix and place the drilling cuttings in suspension in the drill mud, thereby facilitating their removal.

One feature of this invention is the employment of straight mechanical motion, that is without using elastic vibration. This mechanical nutation makes for a simple and compact tool. Equally important is the fact that with the absence of elasticity, as well as without resonance, this straight mechanically nutating tool can be run at a continuous uninterrupted wide range of frequencies, and thus the operator can easily find the best speed or frequency for cutting the work material in certain situations where a particular frequency is desired simply by adjusting the motor means that drives the oscillator which orbitally excites the upper end of the bit as described.

While the invention has been described and illustrated in detail, it is clearly to be understood that this is intended by way of illustration and example only and is not to be taken by way of limitation, the spirit and scope of this invention being limited only by the terms of the following claims.

I claim:

1. A drilling system for drilling through hard material, such system including a drilling bit, the improvement comprising means for cyclically nutating said bit at a sonic frequency comprising:

an orbiting mass oscillator having a rotor, means for connecting said oscillator to said bit for freedom of rotation in a conical orbiting path, means for biasing said bit against the material being drilled, and means for rotatably driving said oscillator rotor in an orbiting path, said oscillator being caused to vibrate in a conical path so as to generate conical vibratory energy, said conical vibratory energy being transferred to said bit, with the top of said oscillator forming the base of the cone and said drill bit nutating at the oscillator frequency around said work material.

2. The device of claim 1 wherein said oscillator has a screw-type rotor and said means for rotatably driving said rotor comprises means for feeding a mud stream to said oscillator.

3. The device of claim 1 or 2 wherein said bit is a roller cone bit.

4. The device of claim 1 wherein said means for connecting said oscillator and said bit for freedom of rotation in a conical orbiting path comprises universal joint means.

5. The device of claim 1 wherein the oscillator rotor is a screw member, said oscillator having a housing with a screw-shaped internal wall portion which mates with the rotor screw member.

6. The device of claim 1 or 2 and further including means for rotating said bit about the longitudinal axis thereof at a frequency susbstantially lower than said sonic frequency.

7. The device of claim 1 or 2 and further including a jacket member and means for mounting said oscillator in said jacket member whereby said jacket member limits the excursion of the oscillator orbit.

8. The device of claim 1 wherein said means for interconnecting the oscillator and the bit for freedom of rotation in an orbital path comprises a resilient bushing.

* * * * *